US006897392B2

(12) United States Patent
Huang

(10) Patent No.: US 6,897,392 B2
(45) Date of Patent: May 24, 2005

(54) ROLLING PRESS MEMBER FOR POWER SWITCH

(75) Inventor: Chyong-Yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 0 days.

(21) Appl. No.: 10/651,940

(22) Filed: Sep. 2, 2003

(65) Prior Publication Data

US 2004/0055863 A1 Mar. 25, 2004

(30) Foreign Application Priority Data

Sep. 23, 2002 (TW) ..... 91214947 U

(51) Int. Cl.[7] ..... H01H 21/80
(52) U.S. Cl. ..... 200/553; 200/315
(58) Field of Search ..... 200/553, 557–559, 200/561, 315, 339

(56) References Cited

U.S. PATENT DOCUMENTS 6,013,885 A * 1/2000 Kowalczyk ..... 200/315
6,459,060 B1 * 10/2002 Bartok ..... 200/553
6,576,855 B2 * 6/2003 Levendis et al. ..... 200/339
6,590,175 B1 * 7/2003 Lam ..... 200/315
6,600,122 B1 * 7/2003 Czarnecki et al. ..... 200/553

* cited by examiner

*Primary Examiner*—Michael A. Friedhofer
(74) *Attorney, Agent, or Firm*—Troxell Law Office, PLLC

(57) ABSTRACT

A rolling press member for power switch includes a metal roller capable of free rolling movements and disposed at an end portion of the press member, with the roller pressing against an internal contact plate. When turning on and off the switch, the roller displaces at the contact plate using rolling movements thereof, thereby enabling smoother operations of the power switch.

2 Claims, 9 Drawing Sheets

ROLLING PRESS MEMBER FOR POWER SWITCH

BACKGROUND OF THE INVENTION (a) Field of the Invention

The invention relates to a rolling press member for power switch, and more particularly, to a rolling press member having a roller at an end portion of the press member placed in a center column of a button, thereby elevating displacement smoothness of a contact plate at an interior of a switch housing.

(b) Description of the Prior Art

Switches are generally provided for various kinds of electric appliances or mechanical apparatus as controlling means for shutting down or conducting power supplies. To be more precise, these switches are utilized for facilitating turning on or off power supplies of these equipments. Referring to FIG. 7 showing a conventional fundamental structure of a common switch, a switch housing A is pivotally disposed with a button B at an upper portion thereof. The button B has a center column B1 at a bottom center thereof. An interior of the center column B1 is provided with an elastic member B2 for pushing against an elastic press member B3, which is pressed against and joined with an arched contact plate C at a bottom portion of the switch housing A. The contact plate C has symmetrical apertures C1 at edges of a middle section thereof, and is erected at a live wire conducting strap D disposed at the bottom portion of the switch housing A via the apertures C1. The contact plate C further has a contact point C2 at one end thereof, and the contact point C2 is in contact with another live wire conducting strap E when being moved downward. As shown in the diagram, in occurrence that the button B is provided with an additional power indication lamp F, the elastic member B2 has two ends thereof in contact with the power indication lamp F and the arch contact plate C along with the press member B3 to form a live wire route. The button B is also provided with an elastic member G connected with the power indication lamp F. The elastic member G is in contact with an earth wire conducting strap H to serve as an earth route of the power indication lamp F. Using the aforesaid structure, pressing of the button B impels swaying of the center column B1 to change a contact status of the contact point C2 of the contact plate C relative to the live wire conducting strap E using the elastic and contractible press member B3, so as to appropriately control conducting or shutting off of the switch. In addition, under a conducted status, the power indication lamp F in the button B is lit up.

However, after thorough study, it is observed that elastic contraction of the press member B3 relative to the contact plate C is performed from swaying of the center column B1 from pressing the button B. Wherein, before being impelled, a status of the hollow press member B3 being contact with the contact plate C is regarded as a "direct contact", meaning that a resistance against sliding movements is comparatively larger with more likely wear from abrasion. Meanwhile, in order to maintain the press member B3 remaining in contact with the elastic member B2 when being pushed downward, it is essential that contraction displacements of the press member B3 relative within the center column B1 be quite smooth in all time, and thus the press member B3 is applied with grease I. Nevertheless, as shown in the diagram, the grease I is often accumulated between a lower end of the center column B1 and the outer surfaces of the press member B3, and therefore reliable lubricating effects between an inner wall of the center column B1 and the press member B3 can hardly be accounted. Above all, when such type of switch is electrically conducted, temperatures of the press member B3 and the contact plate C are elevated. The elevated temperatures melt and drain away the grease I accumulated between the lower end of the center column B1 and the outer surfaces of the press member B3, and thus lubricating effects are made even more unsatisfactory. Similarly, referring to FIG. 8, another type of press member B4 having a solid column also has the aforesaid drawback.

Referring to FIG. 9, the aforesaid press member B3 for switching is replaced by a ball bearing B5 made of metal materials. However, to assemble the ball bearing B5, grease is necessarily applied to outer surfaces of the elastic member B2 after placing the elastic member B2 into the center column B1, so as to temporarily adhere to the ball bearing B5. After placing the contact plate C into the switch housing A, the button B together with the elastic member B2 and the ball bearing B5 are placed into the switch housing A. During the assembly process, the ball bearing B5 not only is prone to fall off due to any slight contact, but may also be easily bounced away when sliding the ball bearing B5 into the center column B1 by pressing the elastic member B2. Therefore, assembly process of this structure is quite complicated while being time consuming.

SUMMARY OF THE INVENTION

The object of the invention is to provide a rolling press member for power switch having an inlayed roller at an end portion of the press member. Using the roller, displacements of a contact plate an interior of a switch housing are made smoother. The invention is characterized that, a metal roller capable of free rolling movements is disposed at an end portion of the press member, with the roller pressing against the internal contact plate. When turning on and off the switch, the roller displaces at the contact plate using rolling movements thereof, thereby enabling smoother operations of the power switch.

DETAILED DESCRIPTION OF THE PREFERRED EMBODIMENTS

To better understand the invention, detailed descriptions shall be given with the accompanying drawings below.

Figure 1:
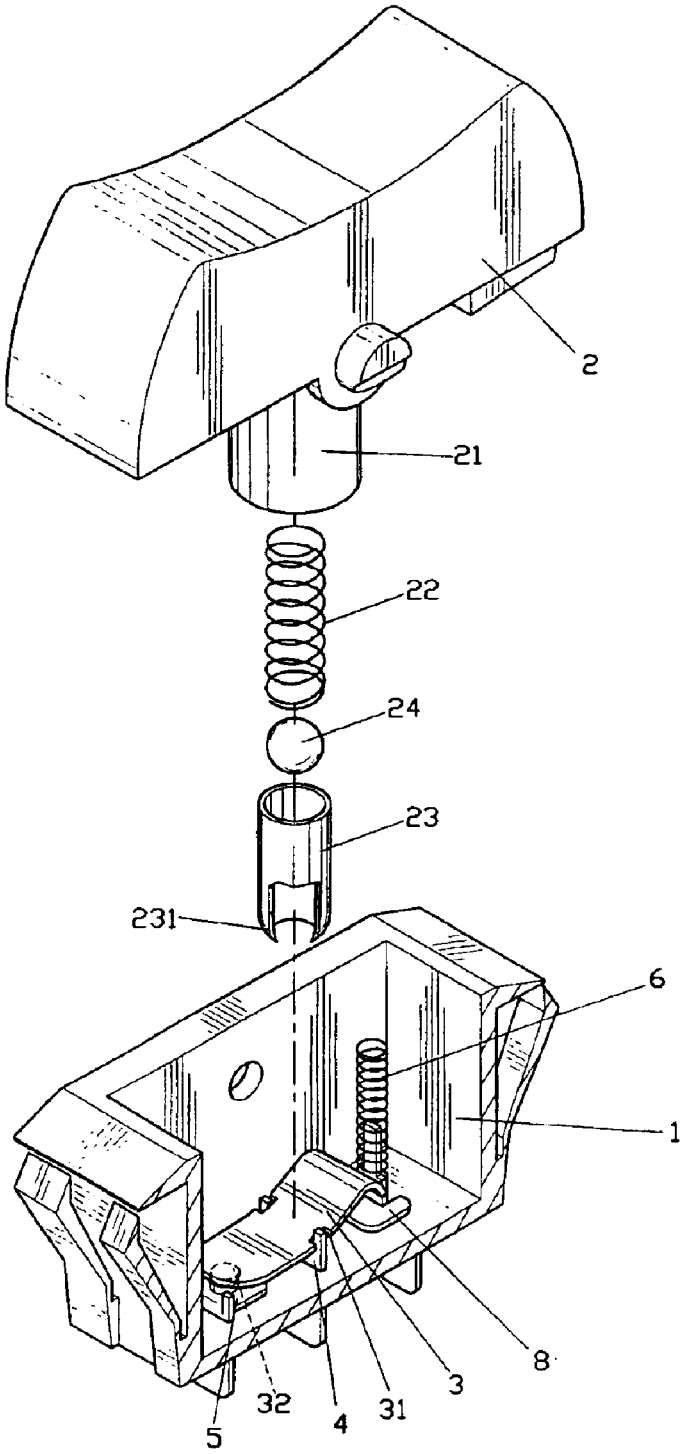
FIG. 1 shows a structural schematic view of a first embodiment according to the invention.
Figure 2:
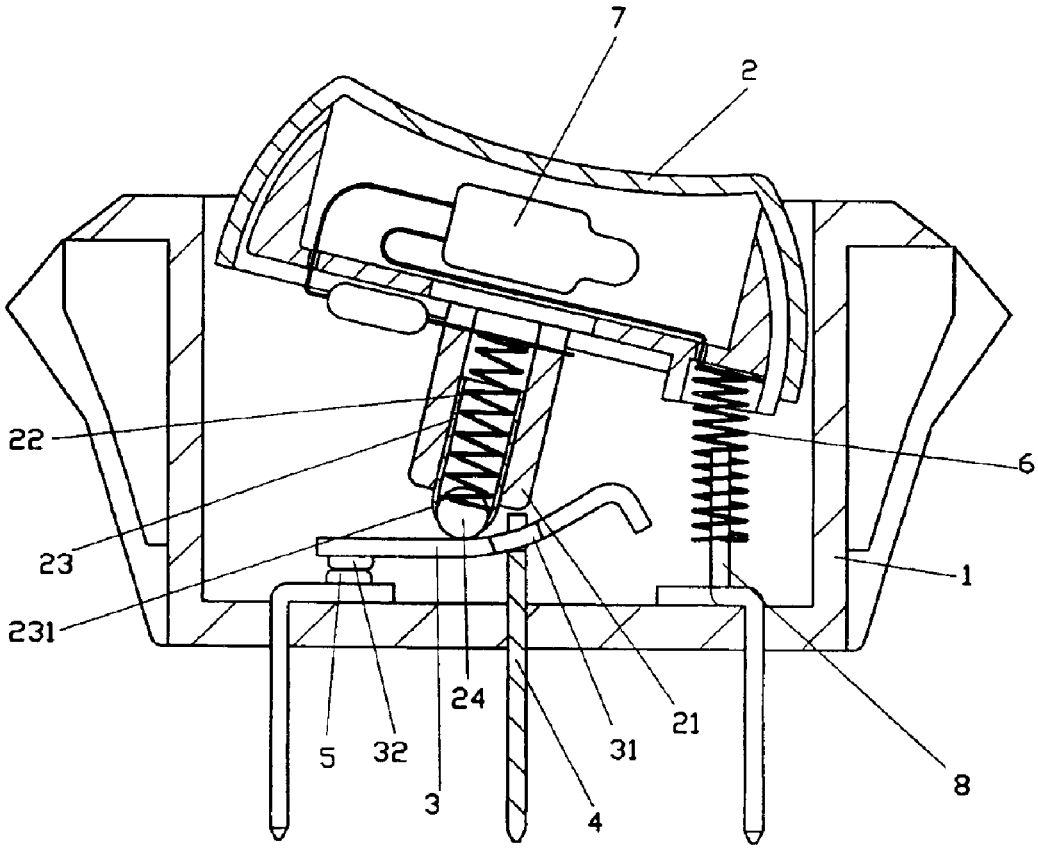
FIG. 2 shows a sectional view of a first embodiment according to the invention.

Referring to FIGS. 1 and 2, a fundamental structure of a switch in a first embodiment according to the invention comprises:

a switch housing 1;

a button 2 pivotally disposed at the switch housing 1; and having a center column 21 formed at a bottom center thereof, and an elastic member 22 disposed at an interior thereof and for pressing against a press member 23 for forming an elastically contractible end;

an arched contact plate 3 being in contact at a bottom portion; and having symmetrical apertures 31 at edges of a middle section thereof that are connected to a conducting strap 4, so as to erect the contact plate 3 at a bottom portion of the switch housing 1, and a contact point 32 at one end thereof, wherein the contact point 32 is in communication with another live wire conducting strap 5 when moving in a downward direction; and an elastic member 6 having one end thereof pushed against a bottom portion of the button 2 to connect with a power indication lamp 7 in the button 2, and the other end pressed against an earth wire conducting strap 8.

Using a hollow tube structure, the press member 23 forms a contracted segment 231 at an outer end of the contact plate 3. An interior of the press member 23 is placed with a roller 24 made of a metal material, such that the roller 24 is partially extended out of the contracted segment 231 without being entirely bounced out to an exterior while being capable of free rolling movements. Furthermore, the elastic member 23 is pushed against the roller 24 to further displace the press member 23, thereby having the partially extended roller 24 at an end portion of the press member 23 come into contact with the contact plate 3. To lubricate the roller 24, grease is injected into the hollow press member 23.

Figure 3:
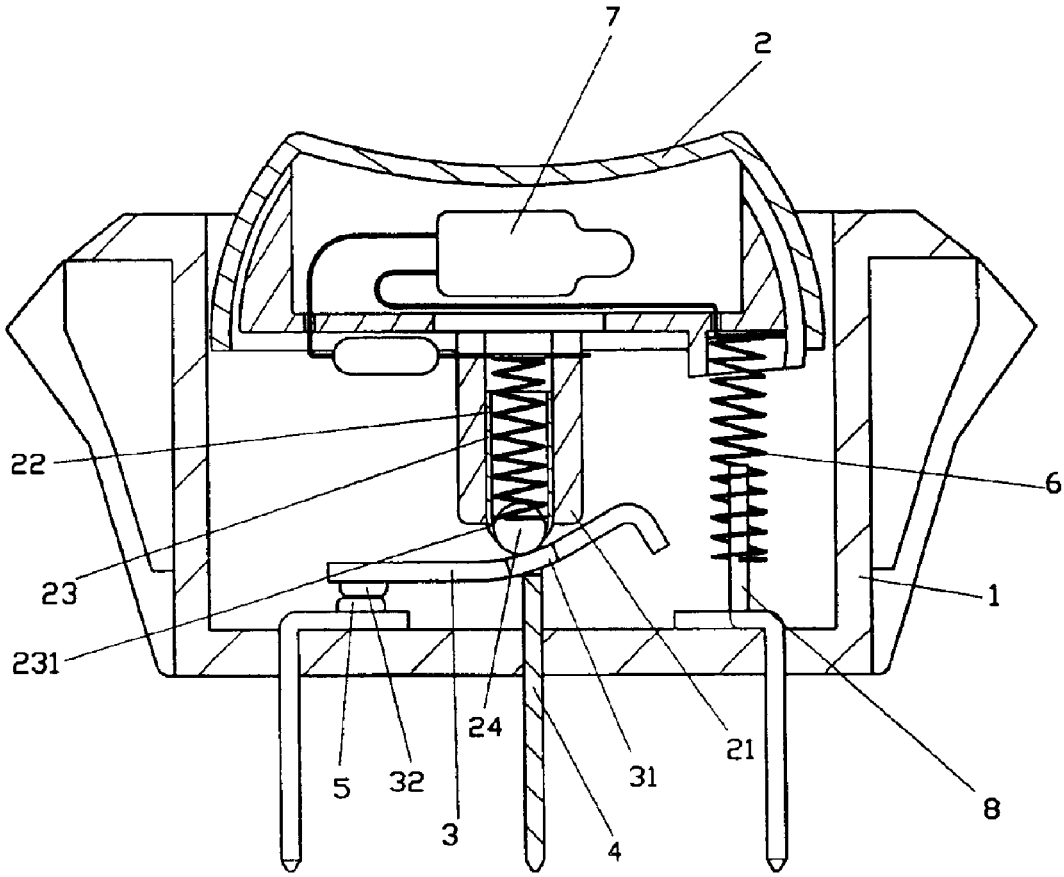
FIG. 3 shows a schematic view showing motions of a first embodiment according to the invention.

Referring to FIG. 3, according to the aforesaid structure, when pressing the button 2 to impel swaying of the center column 21, the extended roller 24 at the end portion of the press member 23 at an interior thereof rolls against the contact plate 3, and the press member 23 forms an elastic contraction mode with the roller 24 due to movements of the elastic member 22 being pressed. Wherein, the roller 24 rolls against the contact plate 3, and a resistance of the rolling movements is rather insignificant for avoiding rapid wear from abrasion. Moreover, according to the aforesaid design, the roller 24 is first disposed in the press member 23 and then placed into the elastic member 22. An assembled structure is installed in the center column 21 followed by fastening of the button 2 in the switch housing 1, and therefore assembly process of the entire structure is made convenient without causing concerns of elements being bounced out.

Apart from the first embodiment, the following designs provide other embodiments in conjunction with the novel characteristics of the roller 24.

Figure 4:
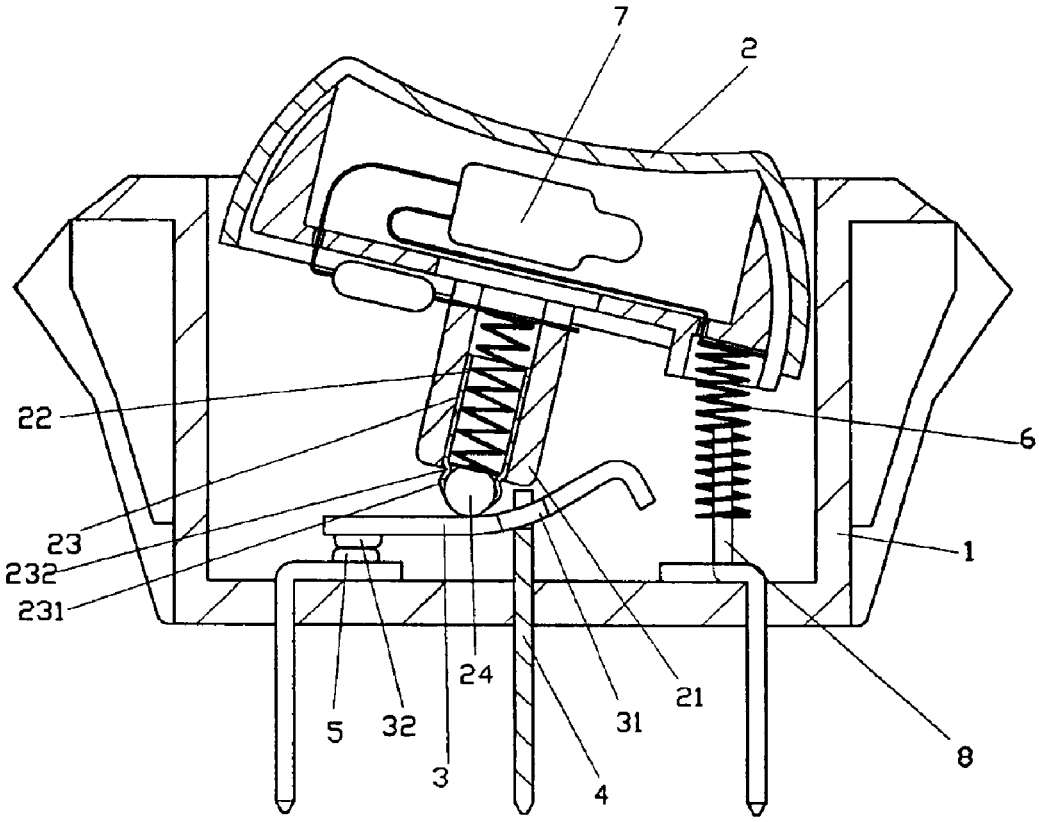
FIG. 4 shows a sectional view of a second embodiment according to the invention.
Figure 5:
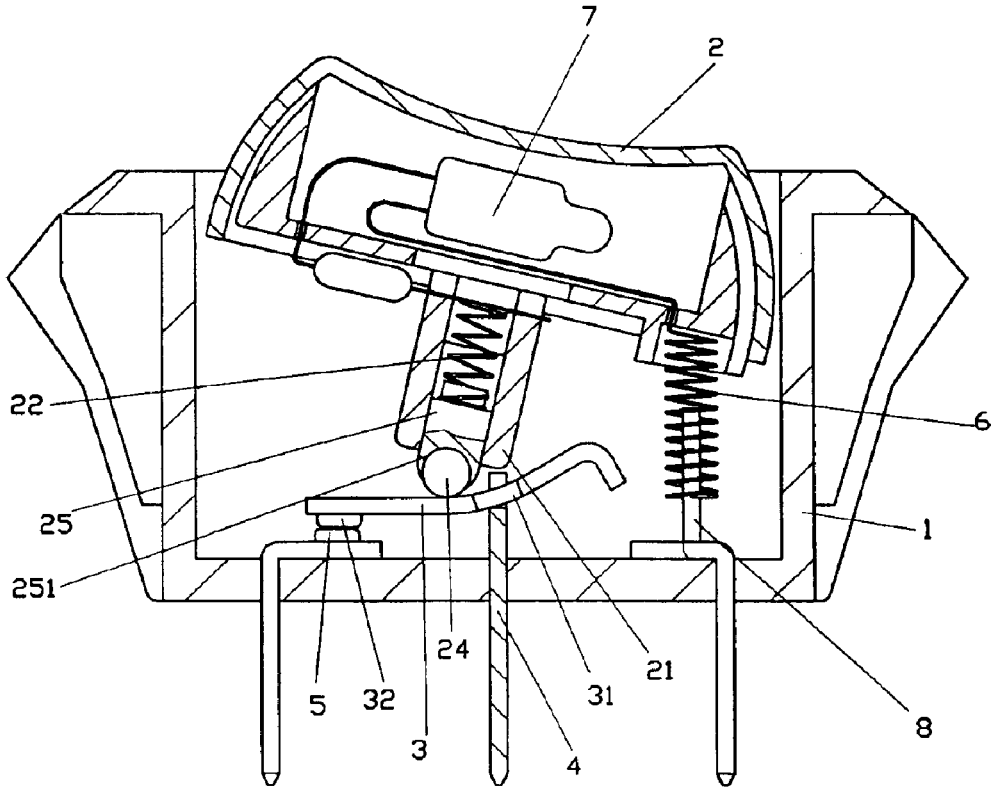
FIG. 5 shows a sectional view of a third embodiment according to the invention.
Figure 6:
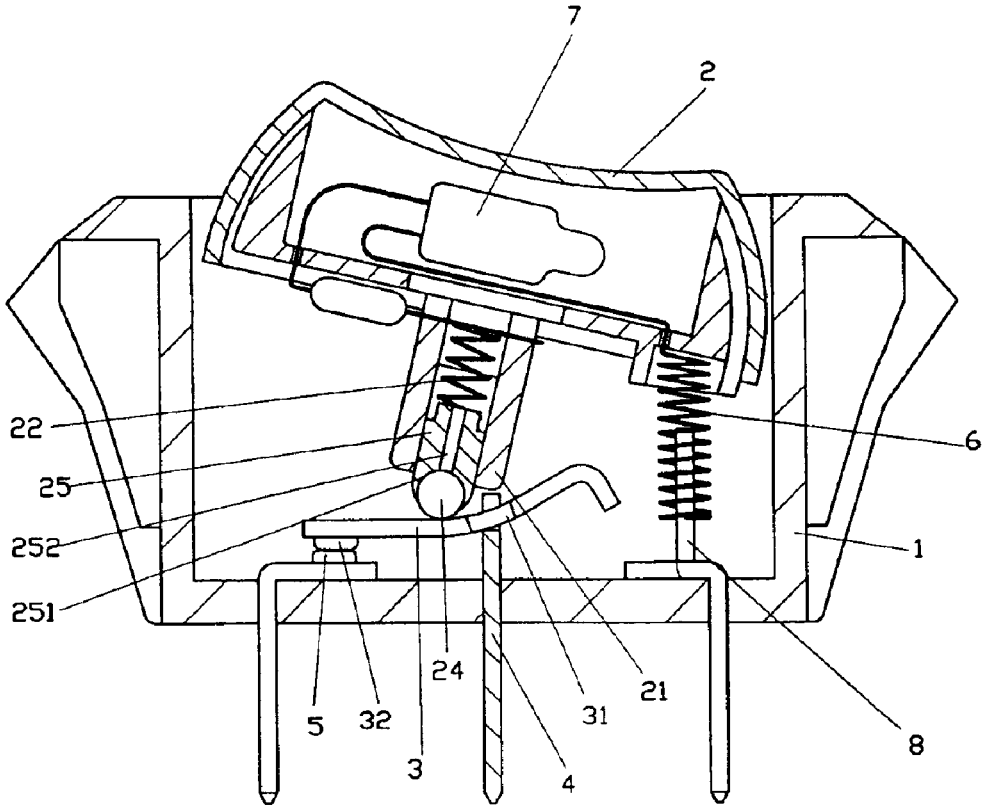
FIG. 6 shows a sectional view of a fourth embodiment according to the invention.
Figure 7:
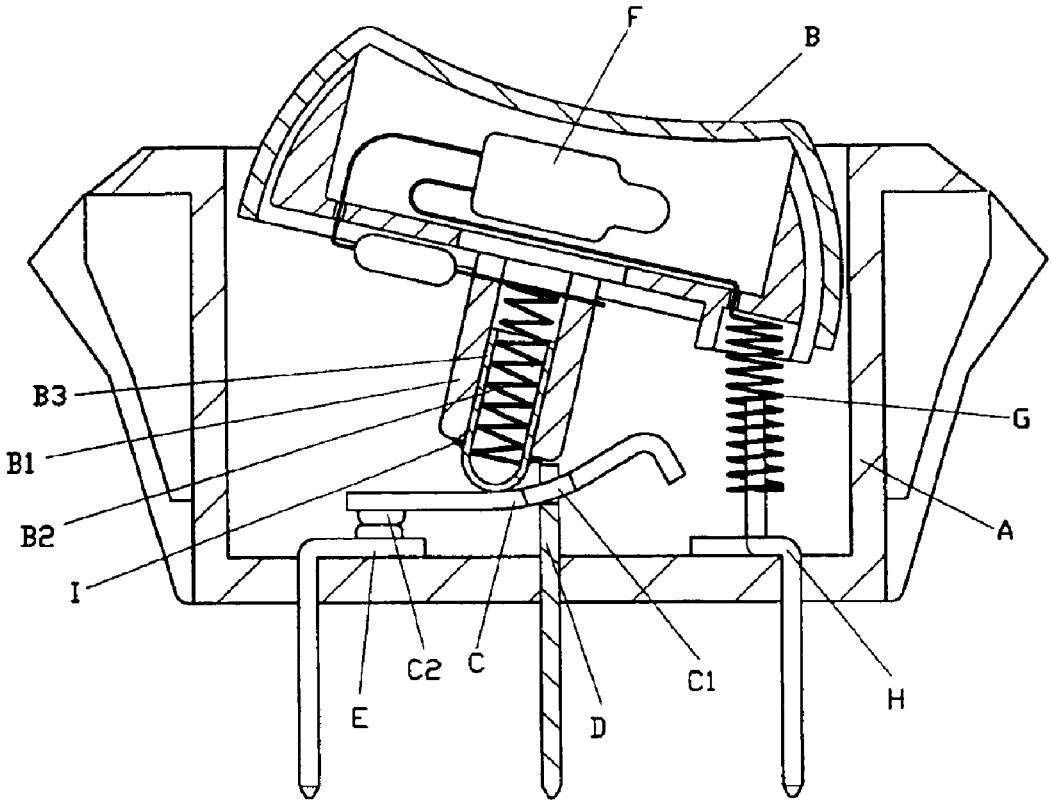
F I G. 7 PRIOR ART
FIG. 7 shows a conventional sectional view of a first prior art.
Figure 8:
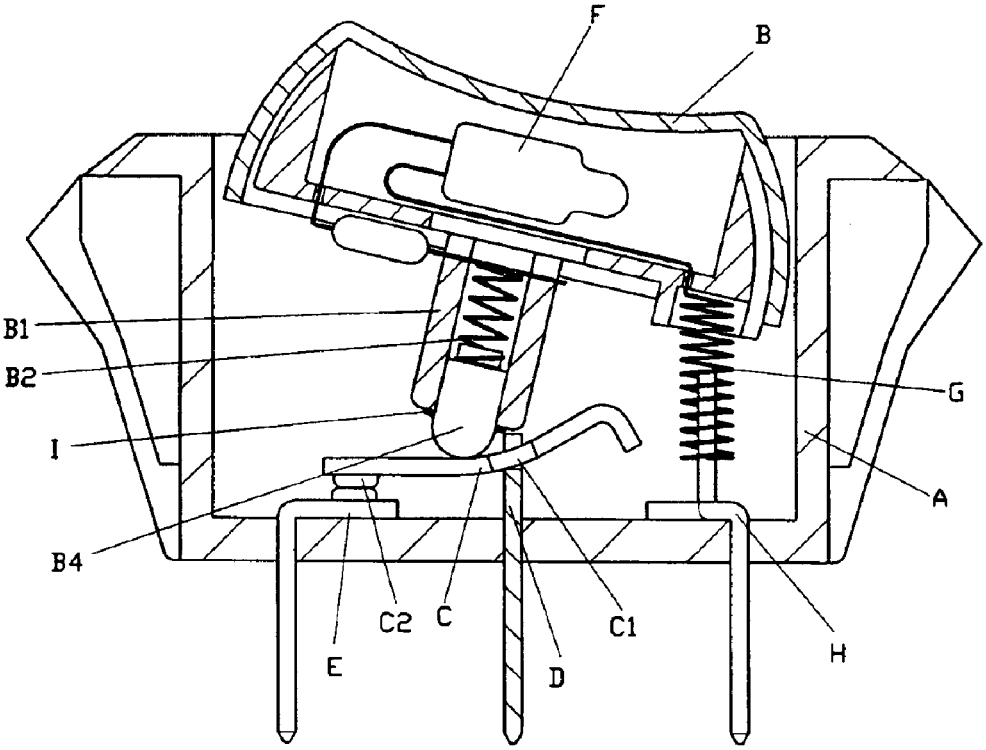
F I G. 8 PRIOR ART
FIG. 8 shows a conventional sectional view of a second prior art.
Figure 9:
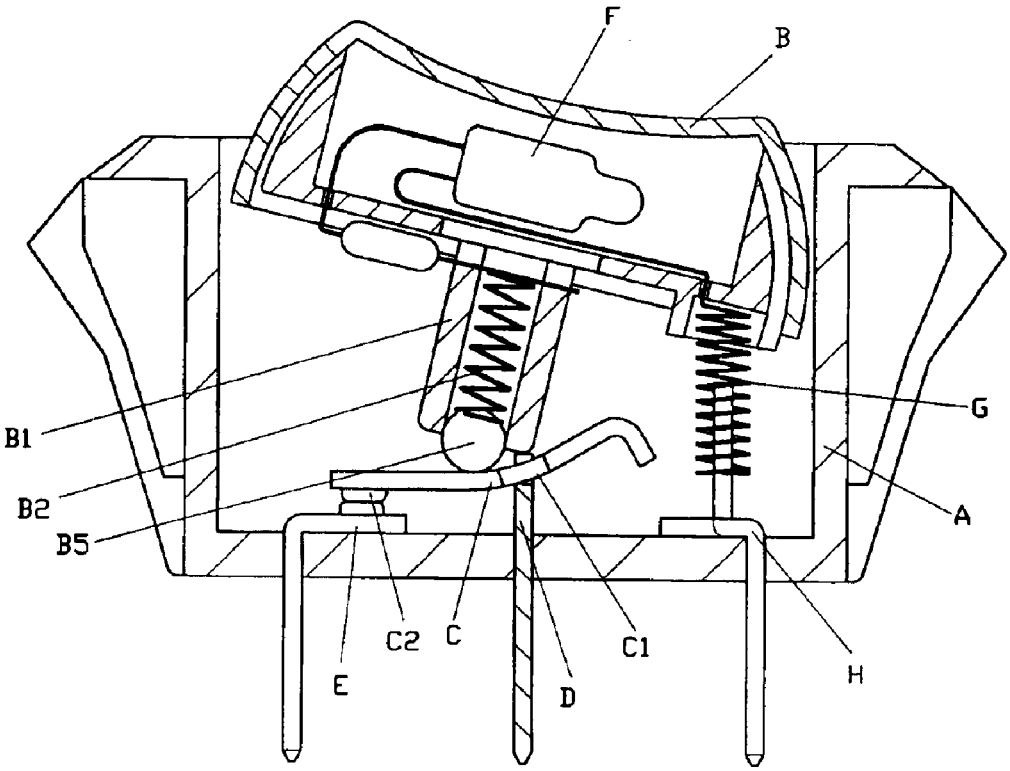
F I G. 9 PRIOR ART
FIG. 9 shows a conventional sectional view of third prior art.

1. Referring to FIG. 4 showing a second embodiment, without being capable of displacements, the roller 24 is located in a fixed position to perform rolling movements relative to the press member 23. A shrunk stop ring 232 is formed at an upper portion of the contracted segment 231 at a front end of the press member 23 and corresponding to an upper side of the roller 24. The roller 24 is retained between an opening of the contracted segment 231 and the ring 232, so as to perform rolling movements in a located region thereof. At the same time, the elastic member 22 has one end thereof pressed against the ring 232 instead of being directly pressed against the roller 24, thereby offering the roller 24 with even more smooth rolling movements relative to the contact plate 3.
2. Referring to FIG. 5 showing a third embodiment, a press member 25 having a solid column is adopted. The press member 25 has a roller recess 251 at one end thereof for accommodating the roller 24. This design locates the roller 24 relative to the press member 24 for rolling movements without allowing the roller 24 with displacements.
3. Referring to FIG. 6 showing a fourth embodiment derived from the third embodiment, to enhance lubricating effects, the solid press member 25 is further provided with a lubrication channel 252 that is in communication with the roller recess 251, so as to lubricate the roller 25 with injected grease.

Moreover, in the aforesaid embodiments, the button 2 is provided with a power indication lamp 7 at an interior thereof. However, the press members 23 and 25 having the roller 24 may also applied in common power switches without the power indication lamp 7, so as to eliminate components of the elastic member 6 and the earth wire conducting strap 8.

Conclusive from the above, according to the rolling press member for power switch, a metal roller is disposed at an end portion of the press member in a hollow or a solid form, and is for coming into contact with a contact plate at an interior of a switching housing using rolling movements thereof. The design not only offers smoother switching of a button, but also minimizes abrasion and wear of internal parts as well as facilitating assembly of all the parts.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A rolling press member for a power switch comprising:

a) a switch housing having:

b) a contact plate located on an interior of the housing and having a contact point;

c) a first live wire conducting strap protruding through the housing and connected to the contact plate; and d) a second live wire conducting strap protruding through the housing and selectively engaged by the contact point; and e) a button pivotally connected to the housing and having:

i) a center column;

ii) a press member inserted into an interior of the center column;

iii) a spherical roller inserted into the press member; and iv) an elastic member located in the center column adjacent to the spherical roller and pressing the spherical roller against the contact plate;

wherein, when the button is pivoted within the housing, the spherical roller rolls along the contact plate and controls the contact point to selectively engage the second live wire conducting strap, wherein the press member includes a roller recess, the spherical roller being inserted into the roller recess, and the press member includes a lubricating channel.

2. The rolling press member according to claim 1, further comprising a power indication lamp located in the button and electrically connected to the elastic member and a ground wire conducting strap.

* * * * *